US007344364B2

(12) United States Patent
Ogawa et al.

(10) Patent No.: US 7,344,364 B2
(45) Date of Patent: Mar. 18, 2008

(54) FLUID MACHINE

(75) Inventors: Hiroshi Ogawa, Nishio (JP); Tadashi Hotta, Nishio (JP); Shigeki Iwanami, Okazaki (JP); Keiichi Uno, Kariya (JP)

(73) Assignees: Nippon Soken, Inc., Nishio (JP); DENSO CORPORATION, Kariya (JP)

( * ) Notice: Subject to any disclaimer, the term of this patent is extended or adjusted under 35 U.S.C. 154(b) by 137 days.

(21) Appl. No.: 11/091,421

(22) Filed: Mar. 29, 2005

(65) Prior Publication Data

US 2005/0220646 A1 Oct. 6, 2005

(30) Foreign Application Priority Data

Mar. 31, 2004 (JP) ..... 2004-104817

(51) Int. Cl.
*F01C 1/02* (2006.01)
*F01C 1/063* (2006.01)

(52) U.S. Cl. ..... 418/55.1; 418/55.5

(58) Field of Classification Search ..... 418/55.1–55.6
See application file for complete search history.

(56) References Cited

U.S. PATENT DOCUMENTS 4,498,852 A * 2/1985 Hiraga ..... 418/55.4
5,242,283 A * 9/1993 Mori et al. ..... 418/55.2
5,249,943 A * 10/1993 Kuroki et al. ..... 418/55.2

FOREIGN PATENT DOCUMENTS

CN 1082146 C 4/2002
JP 05231352 A * 9/1993
JP B-2540738 7/1996
JP A-9-68177 3/1997
JP A-9-151865 6/1997

OTHER PUBLICATIONS

Submission Brief of Publications from Japanese Patent Office issued on Dec. 20, 2006 for the corresponding Japanese patent application No. 2004-104817 (English translation thereof).

"Scroll Expanding Machine, No. 2: Internal Loss of Expanding Machine," *Japan Refrigeration and Air Conditioning Society*. vol. 16, No. 2. (Jul. 31, 1999): pp. 19(123)-28(132).

* cited by examiner

*Primary Examiner*—Thomas Denion
*Assistant Examiner*—Douglas J. Duff
(74) *Attorney, Agent, or Firm*—Posz Law Group, PLC

(57) ABSTRACT

After the tooth portion 102*b* of the stationary scroll 102 and the tooth portion 103*b* of the revolving scroll 103 have contacted each other on one contact face 121 in the central portion of the scroll (shown in FIG. 5A), when this contact face 121 is shifted to two sliding contact portions 122, 123, the operating chamber V is formed between the two sliding contact portions 122, 123 (shown in FIG. 5B), and the refrigerant introducing port 105*a* is open to the region on the contact face 121. Accordingly, the operating chamber can be instantaneously changed over while the sealing property is ensured. Due to the above structure, the sealing property for suppressing leakage from the high pressure side at the time of the expansion mode can be compatible with the smoothing property for smoothing a change-over of the scroll operating chamber successively formed.

1 Claim, 9 Drawing Sheets

FLUID MACHINE

BACKGROUND OF THE INVENTION

1. Field of the Invention

The present invention relates to a scroll type fluid machine having both a compression mode (pump mode) in which fluid is compressed and discharged, and a expansion mode (motor mode) in which fluid pressure at the time of expansion is converted into kinetic energy and outputted as mechanical energy. The present invention is effectively applied to a compressor with which an expander is integrated into one body, which is used for a vapor-compression type refrigerating machine, having a heat recovery system such as the Rankine cycle by which heat energy is recovered.

2. Description of the Related Art

For example, as shown in the official gazette of Japanese Patent No. 2540738, in the case of a conventional vapor-compression type refrigerating machine provided with the Rankine cycle, the compressor of a vapor-compression type refrigerating machine is also used as an expander, that is, the compressor is used both as a compressor and an expander. Therefore, in the case where energy is recovered by the Rankine cycle, the compressor is used as an expander.

However, the following problems may be encountered in the conventional machine. In the case where a scroll type pump is employed as a compressor/expander as described above and compression/expansion is conducted by a normal/reverse rotating motion, the machine is usually designed mainly as a compressor which is operated when a vapor-compression type refrigerating machine is operated. Therefore, when the machine is operated as an expander, the performance of the compressor may not be satisfactory.

Specifically, one of the problems is the opening and closing motion of the suction port of the machine in the case where the machine is used as an expander. In the case where the scroll pump is used as a compressor, it is common that a counterflow of the refrigerant from the high pressure side to the low pressure side is prevented by a discharge valve which is opened and closed by a difference in pressure. This method of preventing the counterflow of the refrigerant is easily executed. However, in the case where the scroll pump is used as an expander, the applying of a valve for preventing the leakage of refrigerant from the high pressure side to the low pressure side is not easy, because the structure becomes complicated and the size is increased. Therefore, in order to prevent leakage of refrigerant from the high pressure side into the operating chamber at the time of the expansion mode, it is preferable that useless leakage of refrigerant be suppressed by enhancing the sealing property of the scroll portion.

Importance is attached to the sealing property by which the leakage of refrigerant from the high pressure side to the low pressure side is suppressed as described above. On the other hand, in order to obtain a continuous and stable flow of refrigerant, it is important that the operating chambers, which are successively formed at the scroll center at the time of the expansion mode, are instantaneously changed over. When the discharge port at the time of the compression mode is used as a suction port at the time of the expansion mode, the suction port is closed over too long a period of time at the time when the operating chamber is changed over, and the operating chamber can not be changed over smoothly.

The present inventors paid attention to the above specific problems and found that the performance at the time when the machine was operated as an expander could be enhanced by appropriately setting the suction port and the scroll center at the time of the expansion mode.

SUMMARY OF THE INVENTION

The present invention has been accomplished in view of the above points. It is an object of the present invention to provide a fluid machine in which the sealing property of suppressing the leakage of refrigerant from the high pressure side to the low pressure side at the time of the expansion mode is compatible with the property of smoothly changing over the scroll chambers which are successively formed.

In order to accomplish the above object, the present invention employs the following technical means.

The present invention provides a fluid machine comprising:

a stationary scroll member (102) having a first tooth portion (102*b*), the shape of which is spiral, and also having a first base portion (102*a*) to support the first tooth portion (102*b*);

a movable scroll member h(103) having a second tooth portion (103*b*), the shape of which is spiral, and also having a second base portion (103*a*) to support the second tooth portion (103*b*), a side of the movable scroll member (103) on which the second tooth portion (103*b*) is formed being opposed to a side of the stationary scroll member (102) on which the first tooth portion (102*b*) is formed, the movable scroll member (103) being revolved while the movable scroll member (103) is prevented from being rotated; and an operating chamber (V) formed between two sliding contact portions (122, 123) with the first tooth portion (102*b*) and the second tooth portion (103*b*) between the two scroll members (102, 103), a volume of the operating chamber (V) being changed by the revolution of the movable scroll member (103), wherein the fluid machine is capable of being operated in a compression mode in which the operating chamber (V) is successively formed in an outer circumferential portion of the stationary scroll member (102) and the volume of the operating chamber (V) is reduced while the operating chamber (V) is being moved toward the center so that fluid can be compressed in and discharged from the operating chamber (V) and also capable of being operated in an expansion mode in which the operating chamber (V) is successively formed at the center of the stationary scroll member (102) and the volume of the operating chamber (V) is increased while the operating chamber (V) is successively formed at the center of the stationary scroll member (102) and moved toward the outer circumferential portion and fluid is expanded in and discharged from the operating chamber (V), and wherein when the fluid machine is operated in the expansion mode, after the first tooth portion (102*b*) and the second tooth portion (103*b*) contact each other on one contact face (121) at the center, when the contact face (121) is shifted to the two sliding contact portions (122, 123), the operating chamber (V) is formed between the two sliding contact portions (122, 123), and the stationary scroll member (102) is open to a region which becomes the contact face (121), and the stationary scroll member (102) has an introducing port (105*a*) for introducing the fluid into the operating chamber (V) formed at the center.

Due to the foregoing, the formation of the operating chamber (V) at the scroll center is started at the time when one contact face (121) of the first tooth portion (102*b*) with the second tooth portion (103*b*) is shifted to two sliding contact portions (122, 123). The operating chamber (V) is interposed between the two sliding contact portions (122, 123) at the beginning of the formation of the operating chamber (V). In this case, the beginning of the formation of the operating chamber (V) is defined as the point of time at which a projection area of the space between the first and the second tooth portion in the direction of the revolution axis of the movable scroll member is changed from zero to a positive value. Accordingly, it is difficult for the fluid to leak into the operating chamber (V) previously formed.

The operating chamber (V) previously formed is closed at the point of time at which the first tooth portion (102*b*) and the second tooth portion (103*b*) contact each other. Immediately after the contact, the fluid is introduced from the introducing port (105*a*) open to the contact face (121) region and the next operating chamber (V) is formed. Accordingly, the fluid is continuously introduced into the operating chamber (V) successively formed.

As described above, while the sealing property is ensured so that leakage of fluid from the high pressure side can be suppressed, the operating chambers, which are successively formed, can be smoothly changed over.

The present invention also provides a fluid machine, in which the introducing port (105*a*) extends from the first base portion (102*a*) in the direction of tooth height of the first tooth portion (102*b*) in the contact face (121) region of the first tooth portion (102*b*).

Due to the foregoing, an opening area of the introducing port (105*a*) in the contact face (121) region of the first tooth portion (102*a*) with the second tooth portion (103*b*) can be enlarged. Accordingly, the fluid can be quickly and positively introduced into the operating chamber (V) formed when one contact face (121) of the first tooth portion (102*b*) with the second tooth portion (103*b*) is shifted to two sliding contact portion (122, 123).

The present invention also provides a fluid machine, in which the extended length (L) of the introducing port (105*a*) in the direction of tooth height of the first tooth portion (102*b*) is less than the height (H) of the first tooth portion (102*b*) in the direction of tooth height.

Due to the foregoing, the introducing port (105*a*) is not extended to a portion of the base portion (103*a*) of the movable scroll member (103). Accordingly, it is difficult for the fluid in the introducing port (105*a*) to leak into the operating chamber (V), which is previously formed, from between the tooth portion (102*b*) of the stationary scroll member (102) and the base portion (103*a*) of the movable scroll member (103). In this way, the sealing property is further enhanced so that leakage of fluid from the high pressure side can be suppressed.

In the conventional case where the machine is designed as a compressor and operated as an expander, the discharge port (105) at the time of the compression mode, which composes the introducing port (105*b*), is usually open to the base portion (102*a*) of the stationary scroll member (102), that is, the discharge port (105) at the time of the compression mode is not provided in the contact face (121) region between the tooth portions (102*b*, 103*b*). In the case where the chip seal (103*e*) is provided on the sliding contact face of the tooth portion (103*b*) of the movable scroll member (103) with the base portion (102*b*) of the stationary scroll member (102), since there is a possibility that the chip seal (103*e*) will be damaged when the locus of the chip seal (103*e*) overlaps the introducing port (105*b*) of the base portion (102*a*) when the movable scroll member (103) is revolved, it is difficult for the chip seal (103*e*) to extend to a forward end portion of the tooth portion (103*b*) of the movable scroll member (103).

However, when the introducing port (105*a*) is provided on the contact face (121) of the first tooth portion (102*b*) with the second tooth portion (103*b*), the chip seal (103*e*) extending in the spiral direction of the second tooth portion (103*b*) extends to the neighborhood of a forward end portion on the center side of the second tooth portion (103*b*) in a region not overlapping the introducing port (105*a*) when the movable scroll member (103) is revolved.

Due to the foregoing, it is possible to enhance the sealing property between the base portion (102*a*) of the stationary scroll member (102) and the tooth portion (103*b*) of the movable scroll member (103).

The present invention may be more fully understood from the description of preferred embodiments of the invention, as set forth below, together with the accompanying drawings.

DESCRIPTION OF THE PREFERRED EMBODIMENTS

Figure 1:
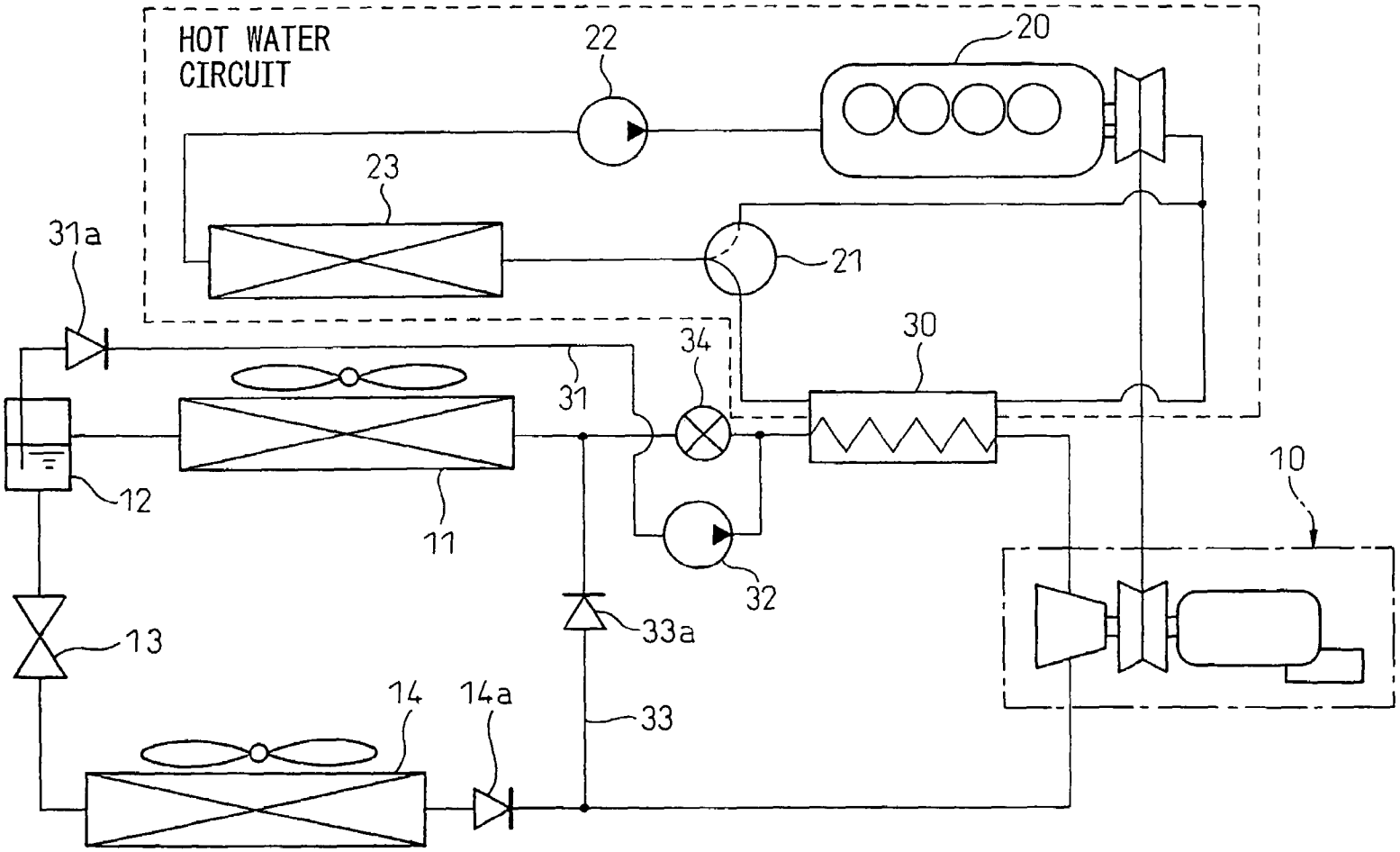
FIG. 1 is a schematic illustration showing a model of the vapor-compression type refrigerating machine provided with the Rankine cycle of an embodiment of the present invention.

Referring to the drawings, an embodiment of the present invention will be explained blow.

In this embodiment, the fluid machine of the present invention is applied to a vapor-compression type refrigerating machine for vehicle use provided with the Rankine cycle. FIG. 1 is a schematic illustration showing a model of the vapor-compression type refrigerating machine related to the present embodiment.

The vapor-compression type refrigerating machine provided with the Rankine cycle related to the present embodiment recovers energy from the waste heat generated from the engine 20 which is a heat engine for generating motive power used for running a vehicle. At the same time, the vapor-compression type refrigerating machine utilizes cold heat and hot heat generated by the vapor-compression type refrigerating machine for air conditioning. The vapor-compression type refrigerating machine provided with the Rankine cycle will be explained as follows.

The compressor 10 with which an expander is integrated into one body is a fluid machine having both a pump mode (compression mode) in which gas-phase refrigerant is compressed and discharged, and a motor mode (expansion mode) in which fluid pressure at the time of expansion of superheated vapor refrigerant is converted into kinetic energy so as to output mechanical energy. The radiator 11 is connected to the delivery side (the high pressure port 110 described later) of the compressor 10, with which an expander is integrated into one body, and cools the refrigerant while heat is radiated from it. In this connection, the compressor 10 with which an expander is integrated into one body will be described in detail later.

The gas-liquid separator 12 is a receiver for separating the refrigerant, which has flowed out from the radiator 11, into gas-phase refrigerant and liquid phase refrigerant, and the decompressor 13 decompresses and expands the liquid-phase refrigerant separated by the gas-liquid separator 12. In this embodiment, the refrigerant is decompressed by an isoenthalpic change, and a thermal type expansion valve is employed which controls the degree of throttle opening so that the degree of superheat of the refrigerant sucked into the compressor 10, with which an expander is integrated into one body, can be a predetermined value.

The evaporator 14 is a heat absorber in which the refrigerant decompressed by the decompressor 13 is evaporated so as to exhibit the heat absorbing action. The vapor-compression type refrigerating machine for removing heat from the low temperature side to the high temperature side includes: the compressor 10 with which an expander is integrated into one body; the radiator 11, the gas-liquid separator 12; the decompressor 13; and the evaporator 14.

The heater 30 is provided in the refrigerant circuit for connecting the compressor 10, with which an expander is integrated into one body, to the radiator 11. The heater 30 is a heat exchanger for heating the refrigerant by exchanging heat between the refrigerant flowing in the refrigerant circuit and the engine coolant. By way of the three-way valve 21, it is changed over between the case in which the engine coolant flowing out from the engine 20 is circulated in the heater 30 and the case in which the engine coolant flowing out from the engine 20 is not circulated in the heater 30. The three-way valve 21 is controlled by an electronic control unit not shown in the drawing.

The first bypass circuit 31 is a refrigerant passage for introducing the liquid-phase refrigerant, which is separated by the gas-liquid separator 12, to the refrigerant entrance side of the radiator 11. In this first bypass circuit 31, the check valve 31*a* is provided which allows the refrigerant to flow only from the liquid pump 32 for circulating the liquid-phase refrigerant and from the gas-liquid separator 12 side to the heater 30 side. In this connection, in this embodiment, the liquid pump 32 is an electric pump, which is controlled by the electronic control unit not shown in the drawing.

The second bypass circuit 33 is a refrigerant passage for connecting the refrigerant delivery side (the low pressure port 111 described later) at the time of operating the compressor 10, with which an expander is integrated into one body, in the motor mode with the entrance side of the refrigerant of the radiator 11. In this second bypass circuit 33, the check valve 33*a* is provided which allows the refrigerant to flow only from the compressor 10, with which an expander is integrated into one body, to the refrigerant entrance side of the radiator 11.

In this connection, the check valve 14*a* allows the refrigerant to flow only from the refrigerant delivery side of the evaporator 14 to the refrigerant suction side (the low pressure port 111 described later) when the compressor 10 with which an expander is integrated into one body is operated in the pump mode. The opening and closing valve 34 is an electromagnetic valve for opening and closing the refrigerant passage and controlled by the electronic control unit not shown in the drawing.

In this connection, the water pump 22 is used for circulating the engine coolant. The radiator 23 is a heat exchanger for cooling the engine coolant by exchanging heat between the engine coolant and the outside air. In this connection, the water pump 22 is a mechanical type pump driven by the engine 20. Of course, however, the water pump 22 may be an electric type pump driven by an electric motor. In this connection, in FIG. 1, the bypass circuit for making the coolant flow by detouring the radiator 23 is omitted, and the flow rate adjusting valve for adjusting the flow rate of the coolant flowing in the bypass circuit and also adjusting the flow rate of the coolant flowing in the radiator 23 is omitted.

Next, the compressor 10 with which an expander is integrated into one body will be described in detail as follows.

Figure 2:
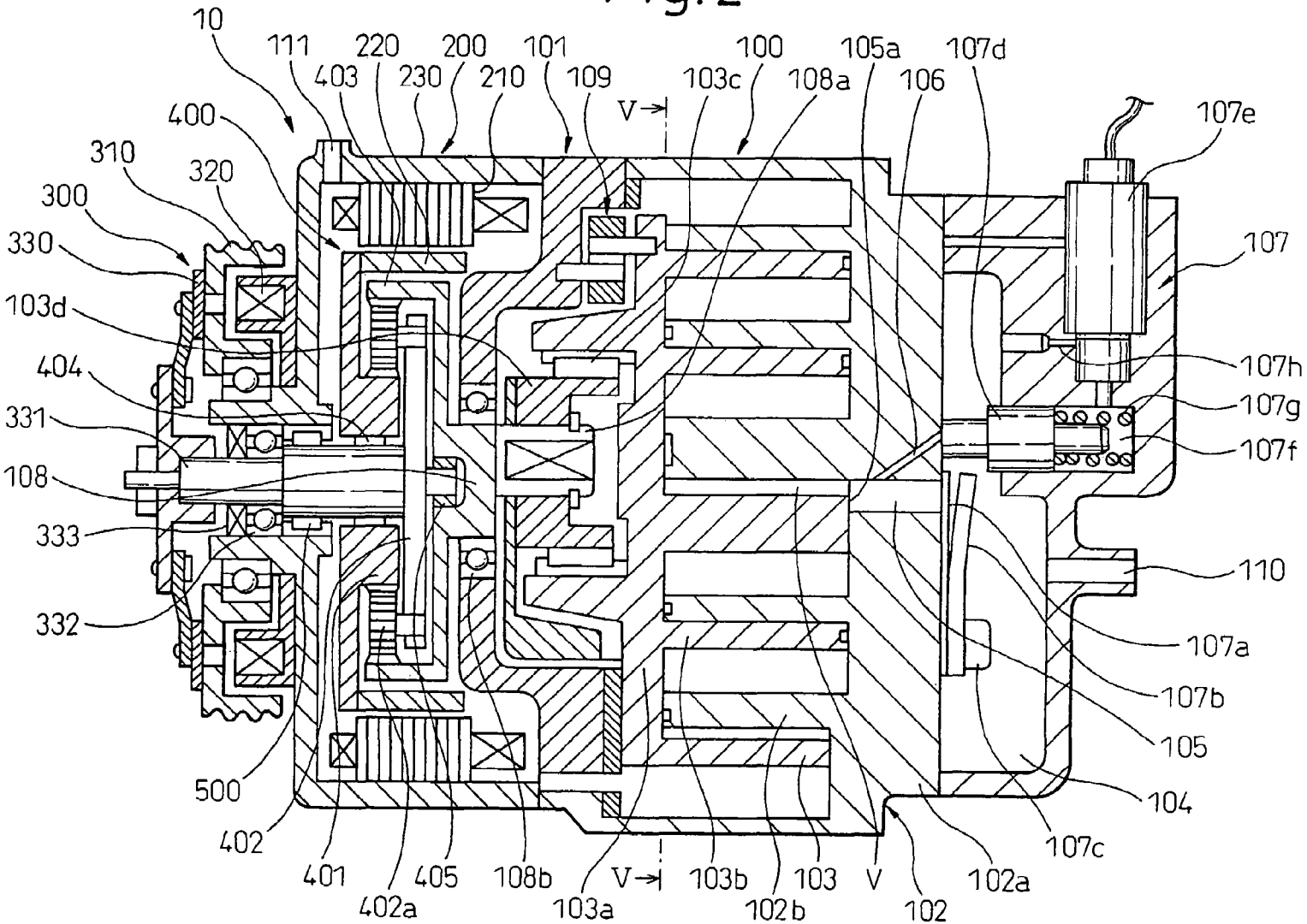
FIG. 2 is a sectional view showing a compressor with which an expander is integrated into one body in an embodiment of the invention.

FIG. 2 is a sectional view of the compressor 10 with which an expander is integrated into one body. The compressor 10 with which an expander is integrated into one body includes: a pump motor mechanism 100 for compressing or expanding fluid (gas-phase refrigerant in this embodiment); a rotary type electrical machine 200 which outputs electric energy when rotary energy is inputted and outputs rotary energy when electric power is inputted; an electromagnetic clutch 300 which constitutes a power transmission mechanism for intermittently transmitting power from the engine 20, which is an external drive source, to the pump motor mechanism 100 side; a pump motor mechanism 100; and a speed change gear mechanism 400, which is composed of a planetary reduction gear mechanism, for changing over the power transmission route between the rotary electrical machine 200 and the electromagnetic clutch 300 and for decreasing or increasing the rotating speed of the rotary power.

In this case, the rotary electrical machine is composed of a stator 210 and a rotor 220 rotating in the stator 210. The stator 210 is a stator coil in which wires are wound, and the rotor 220 is a magnet rotor in which permanent magnets are embedded.

In this embodiment, when electric power is supplied to the stator 210, the rotor 220 is rotated, so that the rotary electrical machine 200 can be operated as an electric motor for driving the pump motor mechanism 100. When torque to rotate the rotor 220 is inputted, the rotary electrical machine 200 can be operated as a generator, which corresponds to the recovery mechanism of the present invention, for generating electric power.

The electromagnetic clutch 300 includes: a pulley 310 for receiving power from the engine 20 via V-belt; an exciting coil 320 for generating a magnetic field; and a friction plate 330 displaced by an electromagnetic force generated by the magnetic field induced by the exciting coil 320. When the engine 20 side is connected to the compressor 10 with which an expander is integrated into one body, an electric current is made to flow in the exciting coil 320. When the engine 20 side is disconnected from the compressor 10 with which an expander is integrated into one body, the electric current flowing in the exciting coil 320 is shut off.

The structure of the pump motor mechanism 100 is approximately the same as the structure of the well known scroll type compressor mechanism. Specifically, the pump motor mechanism 100 includes: a stationary scroll (stationary scroll member, housing) 102 fixed to the stator housing 230 of the rotary electrical machine 200 via the middle housing 101; a revolving scroll (movable scroll member) 103 which is a movable member revolving in a space between the middle housing 101 and the stationary scroll 102; and a valve mechanism 107 for opening and closing the communicating passages 105, 106 to communicate the operating chamber V with the high pressure chamber 104.

In this case, the stationary scroll 102 includes: a base plate portion (a first base plate portion) 102*a*, the shape of which is like a plate; and a tooth portion (a first tooth portion) 102*b*, the shape of which is spiral, protruding from the base plate portion 102*a* to the revolving scroll 103 side. On the other hand, the revolving scroll 103 includes: a tooth portion (a second tooth portion) 103*b*, the shape of which is spiral, contacted and meshed with the tooth portion 102*b*; and a base plate portion (a second base plate portion) 103*a* in which the tooth portion 103*b* is formed. When the revolving scroll 103 is revolved while both the tooth portions 102*b*, 103*b* are coming into contact with each other, a volume of the operating chamber V, which is composed of both the scrolls 102, 103, is expanded and contracted.

The shaft 108 is a crank shaft having an eccentric portion 108*a* which is provided at one end portion in the longitudinal direction of the shaft 108 and formed being eccentric with respect to the rotary central axis. This eccentric portion 108*a* is connected to the revolving scroll 103 via the bushing 103*d* and the bearing 103*c*.

In this connection, the bushing 103*d* can be displaced a little with respect to the eccentric portion 108*a*. Therefore, the bushing 103*d* composes a follower crank mechanism to displace the revolving scroll 103 in the direction so that the contact pressure of both the tooth portions 102*b*, 103*b* can be increased by the compressive reaction force acting on the revolving scroll 103.

The rotation preventing mechanism 109 operates so that the revolving scroll 103 can be revolved by one revolution round the eccentric portion 108*a* while the shaft 108 is rotating by one rotation. Therefore, when the shaft 108 is rotated, the revolving scroll 103 is not rotated but revolved round the central axis of the shaft 108, and the volume of the operating chamber V is reduced when the operating chamber V is displaced from the outer diameter side of the revolving scroll 103 to the central side. In this connection, in this embodiment, the pin-ring (pin-hole) type rotation preventing mechanism is employed as the rotation preventing mechanism 109.

The communicating passage 105 is a discharge port from which the compressed refrigerant is discharged when the operating chamber V, the volume of which becomes minimum at the time of the pump mode, is communicated with the high pressure chamber 104, and the communicating passage 106 is an inflow port for introducing the refrigerant of high temperature and pressure, that is, for introducing the superheated vapor into the operating chamber V when the operating chamber V, the volume of which becomes minimum at the time of the motor mode, is communicated with the high pressure chamber 104.

The communicating passage 106 is formed being joined to the communicating passage 105. The opening portion of the communicating passage 105 on the operating chamber V side is an introducing port 105*a* for introducing the refrigerant into the operating chamber V at the time of the motor mode. The introducing port 105*a* functions as an exit through which the refrigerant flows out from the operating chamber V at the time of the pump mode. The form of the opening of the introducing port 105*a* is the important point of the present invention, and will be described later in detail.

The high pressure chamber 104 has a function of the discharge chamber for smoothing pulsation of the refrigerant discharged from the communicating passage 105 (referred to as a discharge port 105 hereinafter). In this high pressure chamber 104, the high pressure port 110 is provided which is connected to the heater 30 and the radiator 11 side.

In this connection, the low pressure port 111 connected to the evaporator 14 and the second bypass circuit 33 side is provided in the stator housing 230 and communicated with a space between the stator housing 230 and the stationary scroll 102 via the inside of the stator housing 230.

The discharge port 107*a* is a lead type check valve, which is arranged on the high pressure chamber 104 side of the discharge port 105, for preventing a counterflow of the refrigerant, which has been discharged from the discharge port 105, from the high pressure chamber 104 into the operating chamber V. The stopper 107*b* is a valve plate for regulating the maximum degree of opening of the discharge valve 107*a*. The discharge valve 107*a* and the stopper 107*b* are fixed to the base portion 102*a* by the bolt 107*c*.

The spool 107*d* is a valve body for opening and closing the communicating passage 106 (referred to as an inflow port 106 hereinafter). The electromagnetic valve 107*e* is a control valve for controlling the pressure in the back-pressure chamber 107*f* by controlling a state of communication between the low pressure port 111 and the back-pressure chamber 107*f*. The spring 107*g* is an elastic means for imparting an elastic force, by which the inflow port 106 can be closed, on the spool 107*d*. The throttle 107*h* is a resistance means, which has a predetermined passage resistance, for communicating the back-pressure chamber 107*f* with the high pressure chamber 104.

When the electromagnetic valve 107*e* is opened, the pressure in the back-pressure chamber 107*f* is decreased to be lower than the pressure in the high pressure chamber 104. Therefore, while the spool 107*d* is compressing the spring 107*g*, it is displaced onto the right of the drawing, and the inflow port 106 is opened. In this connection, since a loss of pressure in the throttle 107*h* is very large, the quantity of the refrigerant flowing from the high pressure chamber 104 into the back-pressure chamber 107*f* is negligibly small.

In contrast, when the electromagnetic valve 107*e* is closed, the pressure in the back-pressure chamber 107*f* becomes equal to the pressure in the high pressure chamber 104. Accordingly, the spool 107*d* is displaced to the left in the drawing by the force of the spring 107*g*, and the inflow port 106 is closed. That is, a pilot type electric opening and closing valve for opening and closing the inflow port 106 is composed of the spool 107*d*, the electromagnetic valve 107*e*, the back-pressure chamber 107*f*, the spring 107*g* and the throttle 107*h*.

The speed change gear mechanism 400 includes: a sun gear 401 arranged at the central portion; a planetary carrier 402 connected to the pinion gear 402*a* which is revolving on the outer circumference of the sun gear 401 while rotating; and a ring gear 403, the shape of which is a ring shape, arranged on the outer circumference of the pinion gear 402*a*.

The sun gear 401 is integrated into one body with the rotor 220 of the rotary electrical machine 200. The planetary carrier 402 is integrated with the shaft 331 into one body which is integrally rotating with the friction plate 330 of the electromagnetic clutch 300. Further, the ring gear 403 is integrated into one body with the other end portion (the side opposite to the eccentric portion side) of the shaft 108 in the longitudinal direction.

The one-way clutch 500 allows the shaft 331 to be rotated only in one direction (the rotating direction of the pulley portion 310). The bearing 332 pivotally supports the shaft 331. The bearing 404 pivotally supports the sun gear 401, that is, the bearing 404 pivotally supports the rotor 220 with respect to the shaft 331. The bearing 405 pivotally supports the shaft 331 (the planetary carrier 402) with respect to the shaft 108. The bearing 108*b* pivotally supports the shaft 108 with respect to the middle housing 101.

The lip seal 333 is a shaft sealing device for preventing the refrigerant from leaking outside the stator housing 230 from a gap between the shaft 331 and the stator housing 230.

Explanations will be made into the introducing port 105*a* for introducing the refrigerant into the operating chamber V at the time of the motor mode.

Figure 4:
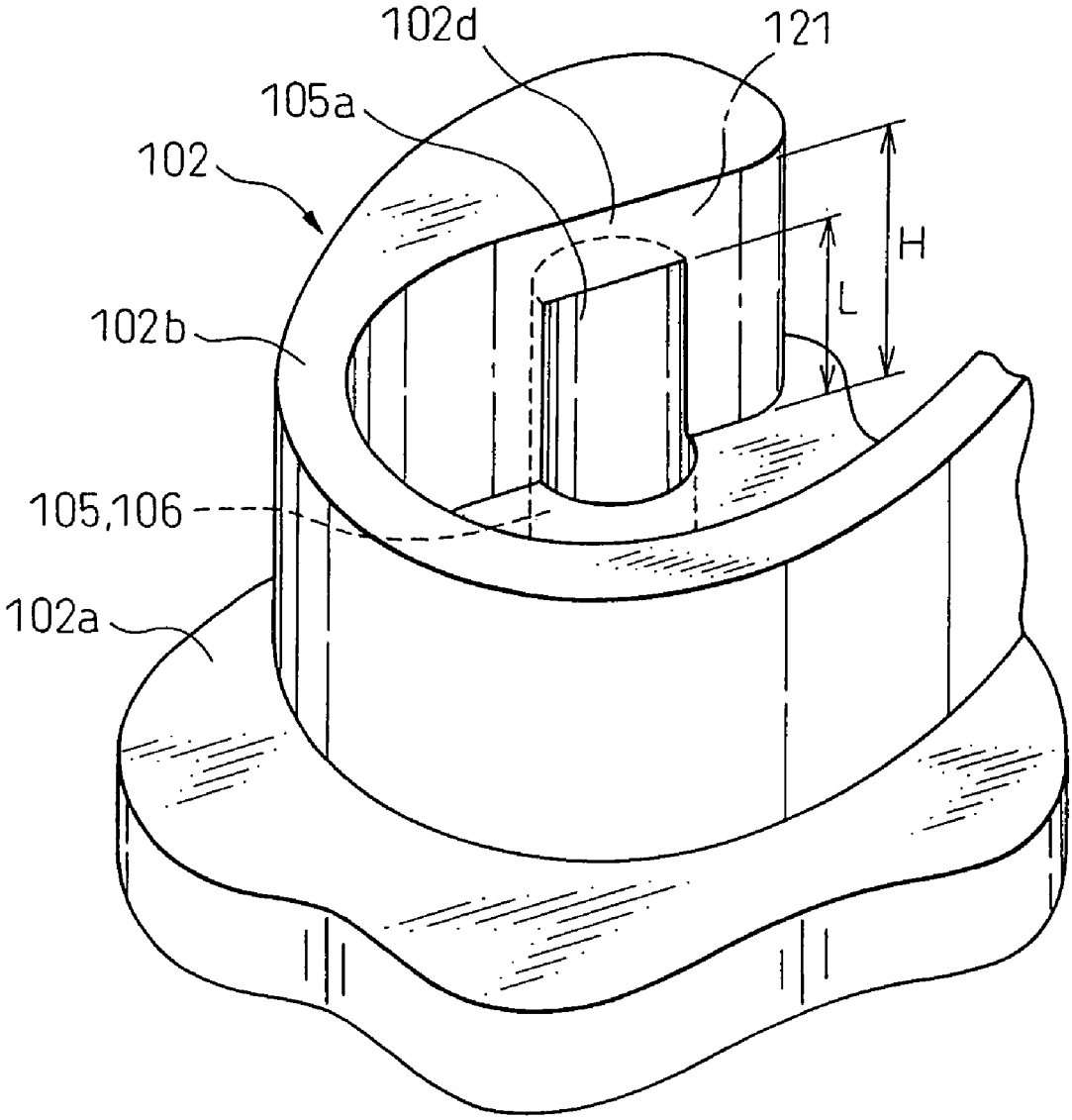
FIG. 4 is a perspective view showing a forward end portion on the center side of the tooth portion of the stationary scroll in an embodiment of the invention.

FIG. 4 is a perspective view showing a forward end portion (a forward end portion on the spiral center side, that is, what is called a winding start portion) of the tooth portion 102*b* of the stationary scroll 102.

As shown in FIG. 4, concerning the discharge port 05 (the inflow port 106) formed penetrating the base plate portion 102*a* of the stationary scroll 102, a portion of the discharge port 105 is formed in the tooth portion 102*b*, that is, a portion of the discharge port 105 extends into the tooth portion 102*b*. The introducing port 105*a*, which is the opening end described before, is open to the neighborhood of the tooth portion 102*b* of the base plate portion 102*a*. At the same time, the introducing port 105*a* is open, extending from the base plate portion 102*a* in the direction of the tooth height of the tooth portion 102*b*.

In the pump motor mechanism 100 of this embodiment, the tooth portion 102*b* of the stationary scroll 102 and the tooth portion 103*b* (shown in FIGS. 1 and 5A to 5D) of the revolving scroll 103 are arranged in such a manner that the tooth portions 102*b*, 103*b* come into contact with each other on one contact face 121 at the scroll center at the time of the motor mode and then form the operating chamber V.

All of the region of the introducing port 105*a* extending in the tooth height direction of the tooth portion 102*b* is open to the region (the region interposed between two one-dotted chain lines), which becomes this contact face 121, in the tooth portion 102*b*.

The extension length L of the introducing port 105*a* in the tooth height direction of the tooth portion 102*b* is less than the height H of the tooth portion 102*b*. Due to the foregoing, the shut-off wall 102*d* is formed on the upper side of the introducing port 105*a* in the drawing. The thus formed shut-off wall 102*d* shuts off the refrigerant flowing from the inflow port 106 to the introducing port 105*a*. Therefore, the refrigerant is prevented from reaching the upper face side (the revolving scroll base plate side) of the tooth portion 102*b* in the drawing.

Next, the operation and the operational effect of the compressor 10, with which an expander is integrated into one body, of the present embodiment will be described below.

1. Pump Mode (Compression Mode)

This mode is an operation mode in which the refrigerant is sucked and compressed by revolving the revolving scroll 103 of the pump motor mechanism 100 when torque is given to the shaft 108.

Specifically, the opening and closing valve 34 is opened under the condition that the liquid pump 32 is stopped, and the three-way valve 21 is changed over so that the engine coolant can not be circulated on the heater 30 side. Under the condition that the electromagnetic valve 107*e* is closed and the inflow port 106 is closed by the spool 107*d*, the shaft 108 is rotated.

Due to the foregoing, in the same manner as that of the well known scroll type compressor, in the compressor 10 with which an expander is integrated into one body, the refrigerant is sucked from the low pressure port 111 and compressed in the operating chamber V moving from the outer circumferential portion of the scroll to the central portion. Then, the thus compressed refrigerant is discharged from the discharge port 105 into the high pressure chamber 104, and the compressed refrigerant is discharged from the high pressure port 110 onto the radiator 11 side.

At this time, there are two cases when torque is given to the shaft 108. One is a case in which the engine 20 side is connected to the compressor 10 side, with which an expander is integrated into one body, by the electromagnetic clutch 300 so that torque can be given by the motive power of the engine 20. The other is a case in which the engine 20 side is disconnected from the compressor 10 side, with which an expander is integrated into one body, by the electromagnetic clutch 300 so that torque can be generated by the rotary electrical machine 200.

In the case in which the engine 20 side is connected to the compressor 10 side, with which an expander is integrated into one body, by the electromagnetic clutch 300 so that torque can be given by the motive power of the engine 20, an electric current is made to flow in the electromagnetic clutch 300 so that the electromagnetic clutch 300 can be connected, and further an electric current is made to flow in the rotary electrical machine 200 so that torque, the intensity of which is so low that the sun gear 401, that is, the rotor 220 cannot be rotated.

Figure 3:
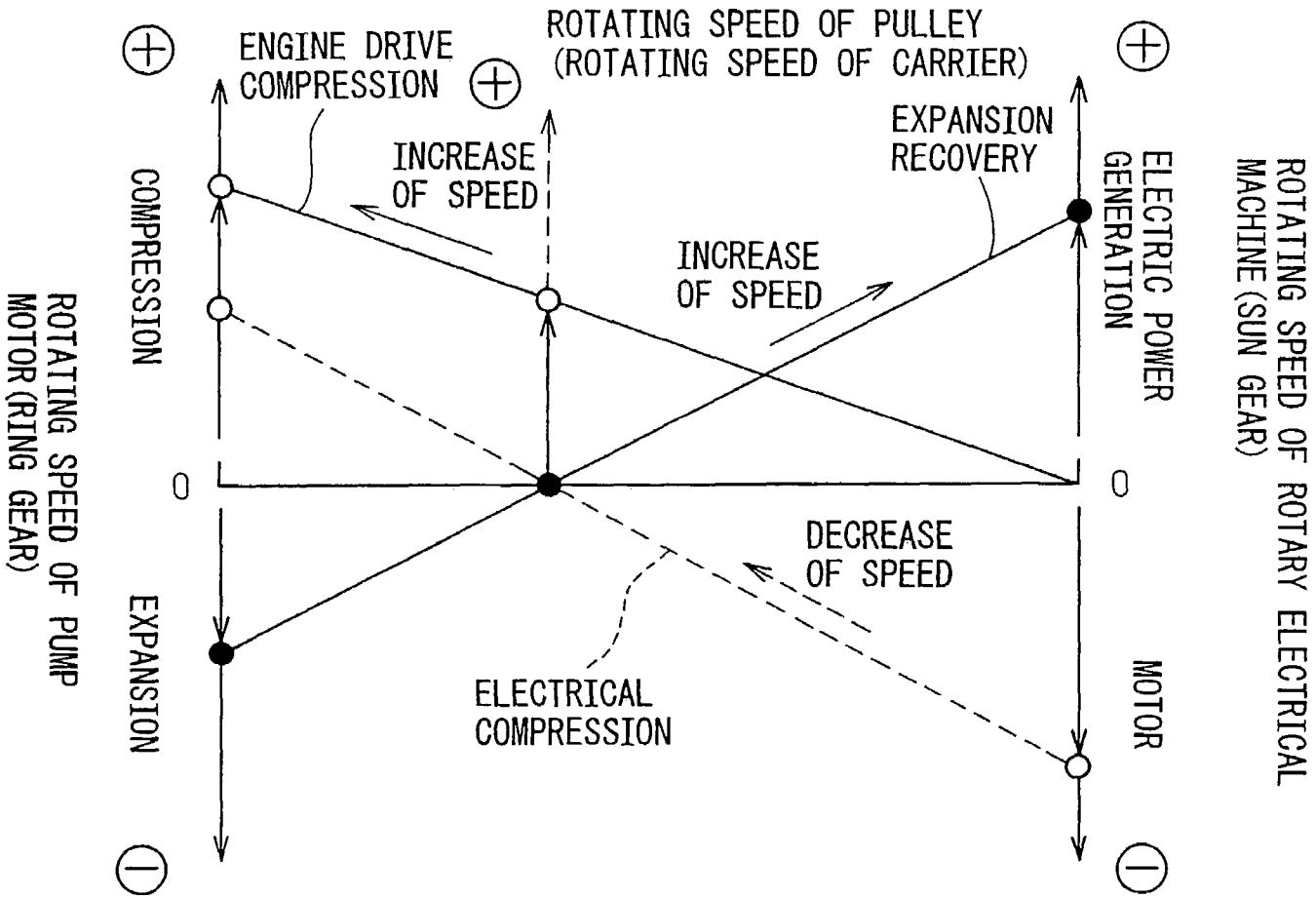
FIG. 3 is a nomographic chart showing operation of the compressor with which an expander is integrated into one body in an embodiment of the invention.

Due to the foregoing, the torque of the engine 20 transmitted to the pulley portion 310 is increased in rotating speed by the speed change gear mechanism 400 and transmitted to the pump motor mechanism 100, so that the pump motor mechanism 100 can be operated as a compressor (drive and compression by the engine in FIG. 3).

In this connection, in the case where the engine 20 side is disconnected from the compressor 10 side, with which an expander is integrated into one body, by the electromagnetic clutch 300 so that torque can be given by the rotary electrical machine 200, when an electric current supplied to the electromagnetic clutch 300 is shut off so as to disconnect the electromagnetic clutch 300 and an electric current is made to flow in the rotary electrical machine 200 so that the machine can be rotated in the opposite direction to the rotary direction of the pulley portion 310, the pump motor mechanism 100 is operated as a compressor.

At this time, the shaft 331 (the planetary carrier 402) is locked by the one-way clutch 500 so that the shaft 331 cannot be rotated. Therefore, the torque of the rotary electrical machine 200 is reduced in rotating speed by the speed change gear mechanism 400 and transmitted to the pump motor mechanism 100 (electrically driven compression in FIG. 3).

The refrigerant discharged from the high pressure port 110 is circulated in the refrigerating cycle in the order of the heater 30→the opening and closing valve 34→the radiator 11→the gas-liquid separator 12→the decompressor 13→the evaporator 14→the check valve 14*a*→the low pressure port 111 of the compressor 10 with which an expander is integrated into one body. Therefore, cooling is conducted by heat absorption by the evaporator 14. Alternatively, heating is conducted by heat radiation by the radiator 11. In this connection, since the engine coolant is not circulated in the heater 30, the refrigerant is not heated by the heater 30, and the heater 30 functions as a simple passage of the refrigerant.

2. Motor Mode (Expansion Mode)

In this mode, when the superheated vapor refrigerant of high pressure in the high pressure chamber 104 heated by the heater 30 is introduced into the pump motor mechanism 100 and expanded, the revolving scroll 103 is revolved to rotate the shaft 108 so that the mechanical output can be obtained.

In this connection, in the present embodiment, the rotor 220 is rotated by the mechanical output obtained and electric power is generated by the rotary electrical machine 200, and the thus generated electric power is stored in a battery.

Specifically, the liquid pump 32 is operated under the condition that the opening and closing valve 34 is closed, and the engine coolant is circulated on the heater 30 side when the engine coolant is changed over by the three-way valve 21. Further, under the condition that an electric current supplied to the electromagnetic clutch 300 of the compressor 10, with which an expander is integrated into one body, is shut off so as to disconnect the electromagnetic clutch 300, the electromagnetic valve 107*e* is opened and the inflow port 106 is opened by the spool 107*d*, and the superheated vapor refrigerant of high pressure in the high pressure chamber 104 heated by the heater 30 is introduced into the operating chamber V via the inflow port 106 and expanded in the operating chamber V formed at the central portion of the scroll and moved to the outer circumferential portion.

Due to the foregoing, by the expansion of the superheated vapor, the revolving scroll 103 is rotated in the direction opposite to the direction at the time of carrying out the pump mode. Therefore, the expanded refrigerant, the pressure of which is lowered, flows out from the low pressure port 111 to the radiator 11 side, and the rotary energy given to the revolving scroll 103 is increased in speed by the speed change gear mechanism 400 and transmitted to the rotor 220 of the rotary electrical machine 200.

Since the shaft 331 (the planetary carrier 402) is locked by the one-way clutch 500 and not rotated at this time, torque of the revolving scroll 103 is increased in its speed by the speed change gear mechanism 400 and transmitted to the rotary electrical machine 200 (the expansion recovery in FIG. 3).

The refrigerant flowing out from the low pressure port 111 is circulated in the order of the second bypass circuit 33→the check valve 33*a*→the radiator 11→the gas-liquid separator 12→the first bypass circuit 31→the check valve 31*a*→the liquid pump 32→the heater 30→the compressor 10 (the high pressure port 110) with which an expander is integrated into one body (the circulation in the Rankine cycle). In this connection, the liquid pump 32 sends the liquid-phase refrigerant into the heater 30 by the pressure at which the superheated vapor refrigerant heated and generated by the heater 30 cannot flow backward to the gas-liquid separator 12 side.

In this case, explanations will be made on the formation of the operating chamber V at the scroll center and the introduction of the refrigerant into the operating chamber V at the time of the motor mode.

FIGS. 5A to 5D are sectional views of the compressor 10, with which an expander is integrated into one body, taken along line V-V in FIG. 2. FIGS. 5A to 5D show a state in which the revolving scroll 103 is revolved by one revolution.

Figure 5A:
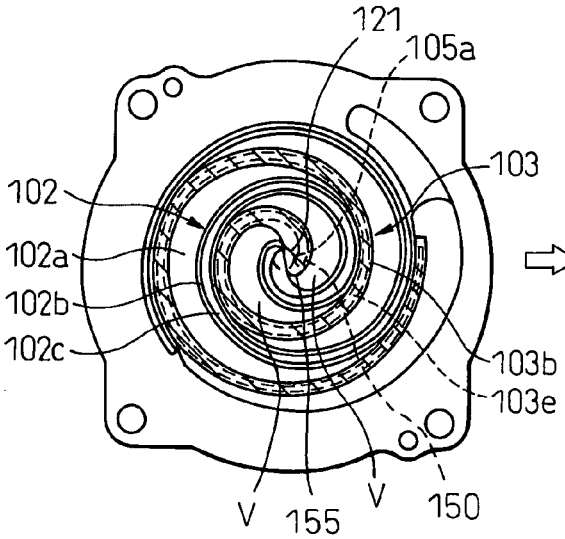
FIGS. 5A to 5D are sectional views taken along line V-V in FIG. 2 showing a state of operation of a revolving scroll.

First of all, as shown in FIG. 5A, the tooth portion 102*b* of the stationary scroll 102 and the tooth portion 103*b* of the revolving scroll 103 come into contact with each other on one contact face 121 at the scroll center.

Figure 5B:
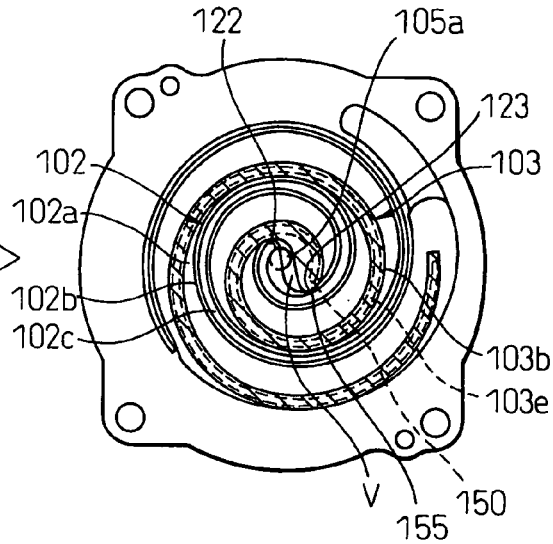

Next, as shown in FIG. 5B, the tooth portion 103*b* of the revolving scroll 103 is moved. When the contact face 121 shown in FIG. 5A is shifted to two sliding contact portions 122, 123, the operating chamber V is formed between the two sliding contact portions 122, 123. At this time, the superheated vapor refrigerant of high pressure is introduced from the introducing port 105*a* into the operating chamber V.

Figure 5D:
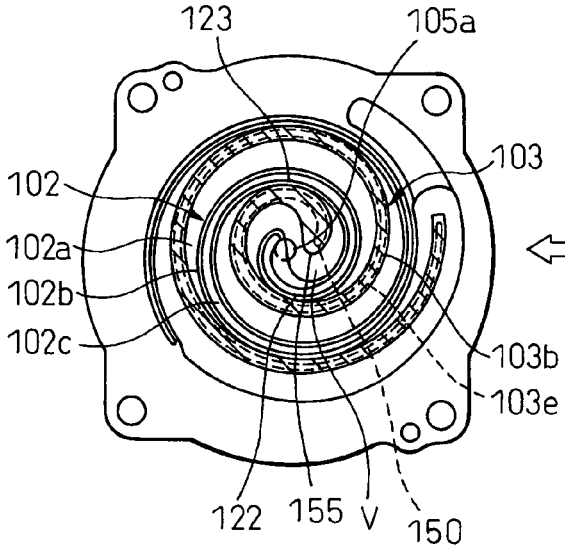
Figure 5C:
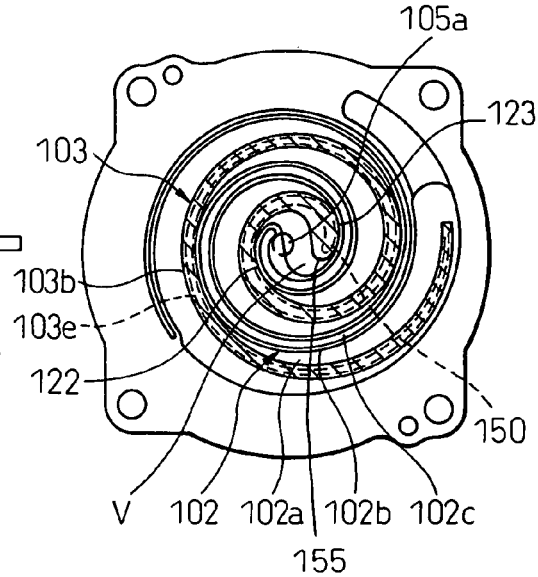

Since the introducing port 105*a* is open to the region of the contact face 121 of the stationary scroll 102, at the point of time when the new operating chamber V is formed at the scroll center (at the point of time when the projection area in the direction of the revolving axis of the revolving scroll 103 in the space between the tooth portions 102*b* and 103*b* is changed from zero to a positive value), the refrigerant is introduced from the introducing port 105*a* into the operating chamber V. As shown in FIGS. 5C and 5D, as the sliding contact portions 122, 123 are moved and the operating chamber V is expanded, the refrigerant of high pressure is continuously introduced into the operating chamber V at the central portion.

When the revolving scroll 103 is returned to the state shown in FIG. 5A after the revolving scroll 103 has been revolved by one revolution, the introducing port 105*a* of the operating chamber V formed at the central portion is closed by the contact portion 121 of the tooth portions 102*b*, 103*b*, and the introduction of the refrigerant into the operating chamber V is stopped and the operating chamber V is divided into two operating chambers V and moved to the outer circumferential portion of the scroll.

Immediately after the state has been returned to the state shown in FIG. 5A, as described before, when the contact face 121 is shifted to the two sliding contact portions 122, 123, the new operating chamber V is formed between the two sliding contact portions 122, 123. At this time, the previously formed operating chamber V, which is being moved to the outer circumferential portion of the scroll being divided, and the newly formed operating chamber V are sealed from each other by the sliding contact portions 122, 123.

Accordingly, it is difficult for the refrigerant of high pressure, which is being introduced into the newly formed operating chamber V, to leak into the previously formed operating chamber V in which the refrigerant is being expanded.

Immediately after the tooth portions 102*b*, 103*b* contact each other on the contact face 121 and the introduction of the refrigerant into the previously formed operating chamber V has been stopped, the introduction of the refrigerant from the introducing port 105*a*, which is open in the region of the contact face 121, into the newly formed operating chamber V is started. Accordingly, the introduction of the refrigerant into the successively formed operating chamber V is not interrupted.

As described above, at the time of the motor mode, while the sealing property is ensured so that leakage of the refrigerant from the high pressure side can be suppressed, the successively formed operating chambers V can be smoothly changed over.

Figure 7A:
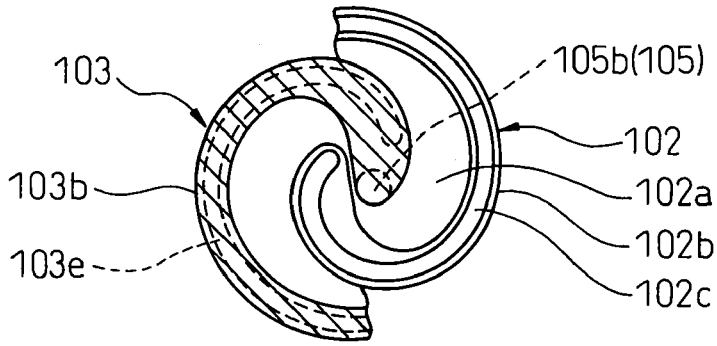
Fig.7A PRIOR ART
FIGS. 7A to 7C are sectional views showing a state of operation of the revolving scroll in the case where the conventional introducing port position is employed.
Figure 7B:
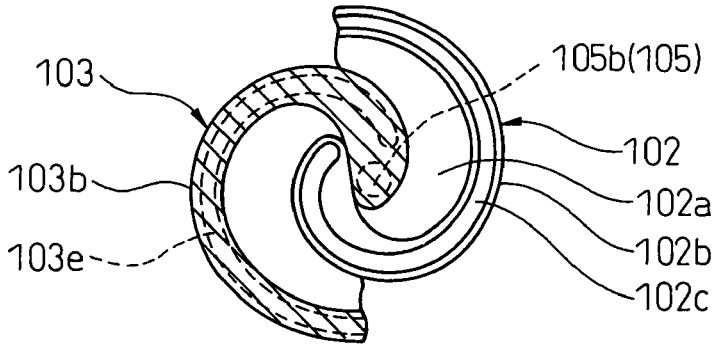
Fig.7B PRIOR ART
Figure 7C:
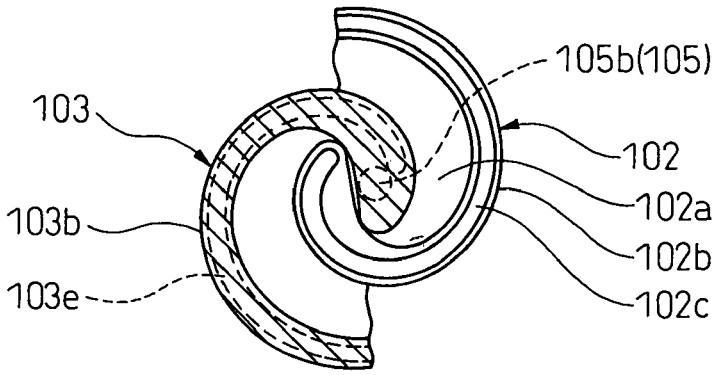
Fig.7C PRIOR ART

In this connection, in the conventional case where the machine is designed as a compressor and operated as an expander, as shown in FIGS. 7A to 7C, the discharge port 105 at the time of the compression mode, which is the introducing port 105*b*, is usually open to the base plate portion 102*a* of the stationary scroll 102.

In the above expander, even when the revolving scroll 103 is revolved in the same manner as that of the present embodiment, in the process from the state, in which the tooth portions 102*b*, 103*b* shown in FIG. 7A contact each other, to the state in which the space is formed between the tooth portions 102*b*, 103*b* shown in FIG. 7C after the state has passed through the contact state shown in FIG. 7B, the introducing port 105*b* is closed and the introduction of the refrigerant is stopped. Accordingly, it is impossible for the operating chamber V to be smoothly changed over.

In the present embodiment, the shut-off wall 102*d* is provided in the tooth portion 102*b* of the stationary scroll 102 on the base portion 103*a* side of the revolving scroll 103 with respect to the introducing port 105*a*. Accordingly, it is difficult for the refrigerant of high pressure to flow from the inflow port 106 to the portion between the tooth portion 102*b* of the stationary scroll 102 and the base plate portion 103*a* of the revolving scroll 103. Accordingly, the sealing property for suppressing the leakage of the refrigerant from the high pressure side can be further enhanced.

In the present embodiment, as shown in FIGS. 5A to 5D, on the sliding contact face (the spiral end face) of the tooth portion 102*b* of the stationary scroll 102 with the base plate portion 103*a* of the revolving scroll 103, the chip seal 102*c* is provided, and on the sliding contact face (the spiral end face) of the tooth portion 103*b* of the revolving scroll 103 with the base plate portion 102*a* of the stationary scroll 102, the chip seal 103*e* is provided, so that the sealing property of each sliding contact portion can be enhanced.

Figure 8:
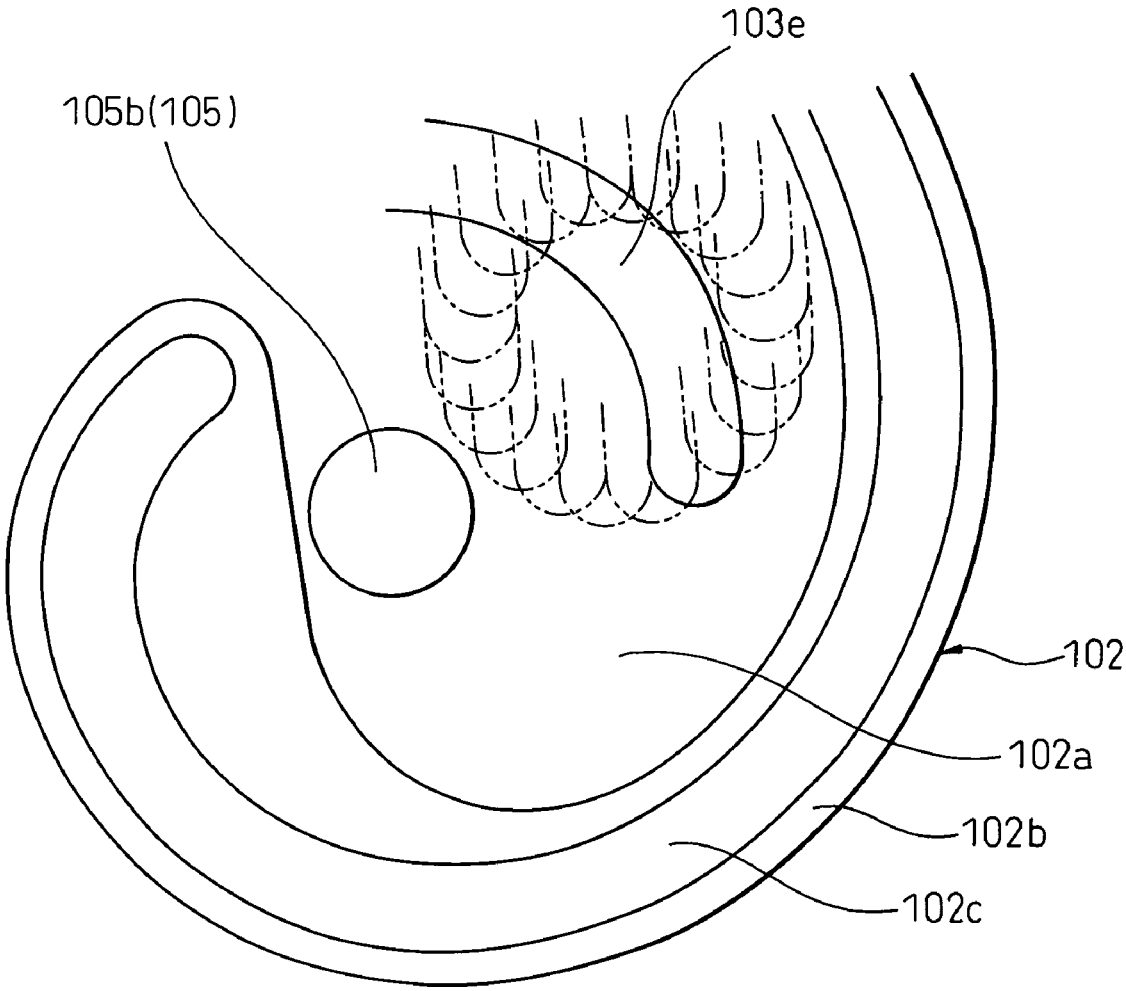
Fig. 8 PRIOR ART
FIG. 8 is a view showing a locus of the chip seal of the revolving scroll in the case where the conventional introducing port position is employed.

In the conventional case where the machine is designed as a compressor and operated as an expander, as shown in FIG. 8, the discharge port 105 at the time of the compression mode, which is the introducing port 105*b*, is usually open to the base plate portion 102*a* of the stationary scroll 102. Therefore, the discharge port 105 at the time of the compression mode is not provided in the contact face region in which the tooth portions contact each other.

In the case where the chip seal 103*e* is provided in the tooth portion 103*b* (shown in FIGS. 7A to 7C) of the revolving scroll 103, since there is a possibility that the chip seal 103*e* will be broken when the locus (the locus shown by the two-dotted chain lines in FIG. 8) of the chip seal 103*e* at the time of revolution of the revolving scroll 103 overlaps the introducing port 105*b*, it is impossible for the chip seal 103*e* to extend to a forward end portion of the tooth portion 103*b* of the movable scroll 103 (shown in FIGS. 7A to 7C). In this case, FIG. 8 shows only a positional relation between the stationary scroll 102 and the chip seal 103*e* on the revolving scroll side.

Figure 6:
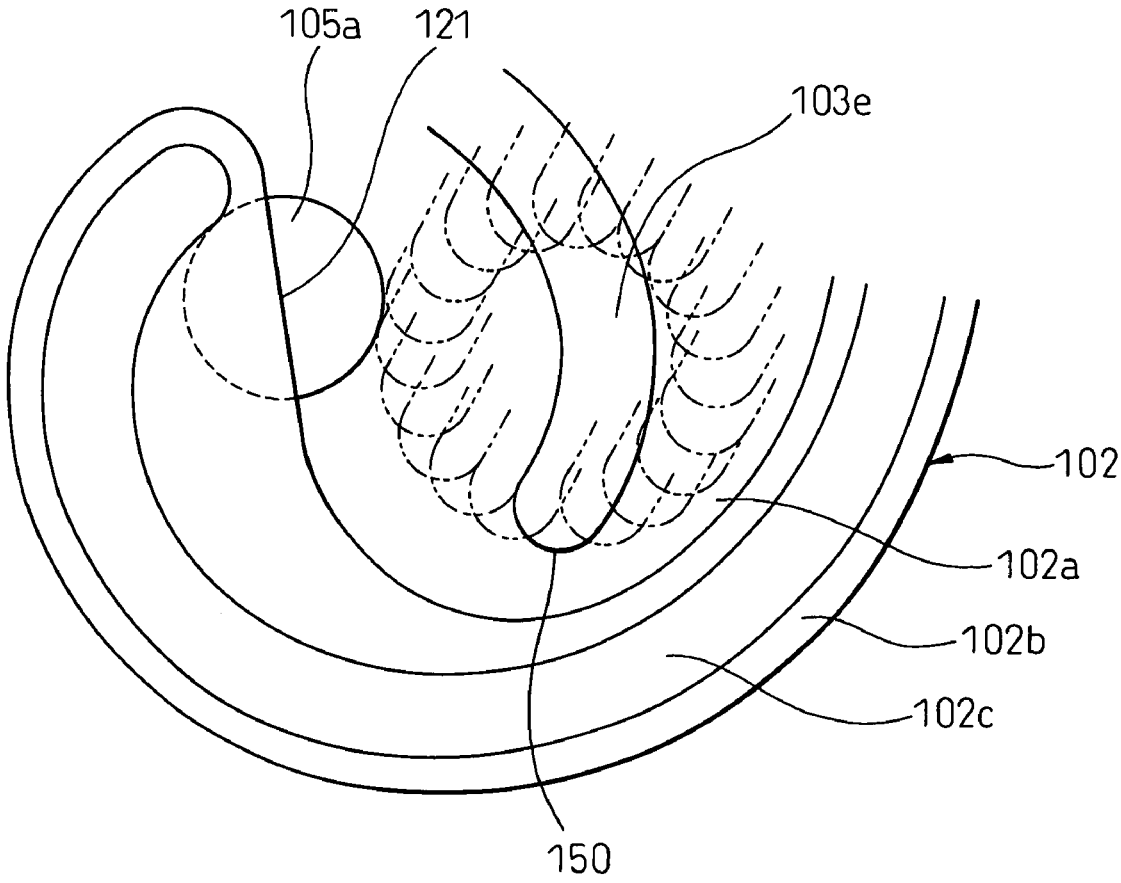
FIG. 6 is a view showing a locus of the chip seal of the revolving scroll of an embodiment of the invention.
Figure 9:
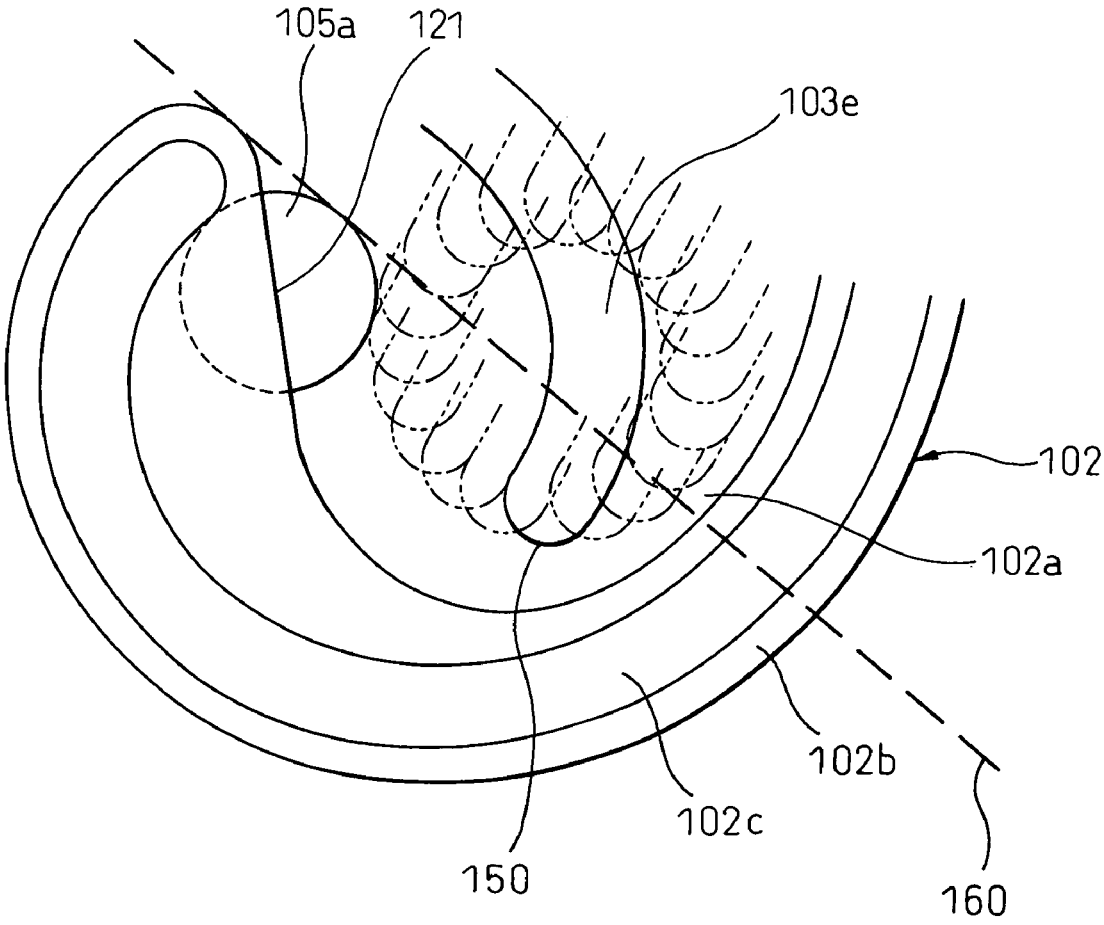
FIG. 9 is a view showing the locus of the chip seal of the revolving scroll of an embodiment of the invention with respect to a boundary line.

However, according to the present embodiment, when the introducing port 105*a* is provided on the contact face 121 of the tooth portion 102*b* with the tooth portion 103*b*, as shown in FIG. 6, in the region in which the chip seal 103*e* on the revolving scroll side does not overlap the introducing port 105*a* when the revolving scroll 103 is revolved, the chip seal 103*e* on the revolving scroll side can extend to a portion close to the forward end 155 on the central portion side of the tooth portion 103*b* while the chip seal 103*e* is evading the introducing port 105*a* (shown in FIGS. 5A to 5D). Further, as shown in FIG. 9, the distal end 150 of the chip seal 103*a* reaches a portion close to the forward end portion 155 on a center side of the second tooth portion 103*b* in a region beyond an imaginary boundary line 160 passing through a distal end of the first tooth portion 102 and an outer edge of the introducing port 105*a*. Further, a revolving trace of the chip seal passes next to an outer edge of the first tooth portion 102*b*.

Due to the foregoing, the sealing property for sealing a portion between the base plate portion 102*a* of the stationary scroll 102 and the tooth portion 103*b* of the revolving scroll 103 can be enhanced. FIG. 6 is a view showing only a positional relation between the stationary scroll 102 and the chip seal 103*e* on the revolving scroll side.

In this connection, the contact portion or the sliding contact portion in the explanations of the present embodiment is not necessarily limited to a portion in which contact is made in the strict meaning of the term. The contact portion or the sliding contact portion in the explanations of the present embodiment includes a portion in which a small clearance is formed between two faces so that the scroll can be easily revolved. That is, even when a contact or sliding contact in the strict meaning is not made in the portion, as long as the portion divides the operating chamber, that is, as long as the portion seals between the operating chambers so that each operating chamber can be made to function, the portion can be defined as a contact or sliding contact portion. In other words, even when the contact face or the sliding contact face is not a contact or a sliding contact in the strict meaning of the term, as long as it can divide the operating chamber, that is, as long as it can seal between the operating chambers so that each operating chamber can be made to function, any contact or sliding contact portion can be applied to this embodiment. Thus, a rough contact or a rough sliding contact, in which a small clearance is formed, can be said to be a substantial contact or a substantial sliding contact.

In the embodiment described above, the introducing port 105*a* extends in the tooth height direction of the tooth portion 102*b* and is open to the region which becomes the contact face 121. However, as long as the introducing port 105*a* is open to the region of the contact face 121 of the stationary scroll 102, for example, it may be open only to the base plate portion 102*a*, that is, it may be open to a side portion on the base plate portion 102*a* side of the contact face 121 region, that is, any introducing port 105*a* may be employed.

In the embodiment described above, energy recovered by the compressor with which an expander is integrated into one body is stored in a battery. However, energy recovered by the compressor may be stored as kinetic energy by using a fly wheel or may be stored as mechanical energy such as elastic energy by using a spring.

In the embodiment described above, the speed change gear mechanism 400 is composed of a planetary reduction gear mechanism. However, it should be noted that the present invention is not limited to the above specific embodiment. A transmission mechanism capable of changing the ratio of transmission such as CVT (a belt type non-stage transmission mechanism) or a toroidal type transmission mechanism may be employed. It is possible to apply the present invention to a compressor, with which an expander is integrated into one body, having no transmission mechanism.

In the embodiment described above, the fluid machine of the present invention is applied to a vapor compression type refrigerating machine for vehicle use having the Rankine cycle. However, the present invention is not limited to the above specific embodiment.

While the invention has been described by reference to the specific embodiments chosen for purposes of illustration, it should be apparent that numerous modifications could be made thereto by those skilled in the art without departing from the basic concept and scope of the invention.

The invention claimed is:

1. A fluid machine comprising:

a stationary scroll member having a first tooth portion, the shape of which is spiral, and also having a first base portion to support the first tooth portion;

a movable scroll member having a second tooth portion, the shape of which is spiral, and also having a second base portion to support the second tooth portion, a side of the movable scroll member on which the second tooth portion is formed being opposed to a side of the stationary scroll member on which the first tooth portion is formed, the movable scroll member being revolved while the movable scroll member is prevented from being rotated; and an operating chamber (V) formed between two sliding contact portions with the first tooth portion and the second tooth portion between the two scroll members, a volume of the operating chamber (V) being changed by the revolution of the movable scroll member, wherein the fluid machine is capable of being operated in a compression mode in which the operating chamber (V) is successively formed in an outer circumferential portion of the stationary scroll member and a volume of the operating chamber (V) is reduced while the operating chamber (V) is moved toward the center so that fluid can be compressed in and discharged from the operating chamber (V) and also capable of being operated in an expansion mode in which the operating chamber (V) is successively formed at the center of the stationary scroll member and the volume of the operating chamber (V) is increased while the operating chamber (V) is being successively formed at the center of the stationary scroll member and moved toward the outer circumferential portion and fluid is expanded in and discharged from the operating chamber (V), wherein when the fluid machine is operated in the expansion mode, after the first tooth portion and the second tooth portion contact each other on one contact face at the center, when the contact face is shifted to the two sliding contact portions, the operating chamber (V) is formed between the two sliding contact portions, wherein the stationary scroll member is open to a region which becomes the contact face, and the stationary scroll member has an introducing port for introducing the fluid into the operating chamber (V) formed at the center, wherein the introducing port extends from the first base portion in the direction of tooth height of the first tooth portion in the contact face region of the first tooth portion, wherein the extended length (L) of the introducing port in the direction of tooth height of the first tooth portion is less than the height (H) of the first tooth portion in the direction of tooth height, wherein the second tooth portion has a chip seal, which extends in the spiral direction of the second tooth portion, on the sliding contact face with the first base portion, wherein the chip seal extends along the second tooth portion and does not overlap with the introducing port during a revolution of the movable scroll member, wherein the distal end of the chip seal reaches to a portion close to a forward end portion on the center side of the second tooth portion in a region deeper beyond an imaginary boundary line passing through a distal end of the first tooth portion and an outer edge of the introducing port, and wherein a revolving trace of the chip seal passes next to the outer edge of the first tooth portion.

* * * * *